United States Patent [19]

Dholakia

[11] 4,365,447

[45] Dec. 28, 1982

[54] APPARATUS AND METHOD FOR SHARPENING A CUTTING STYLUS

[75] Inventor: Anil R. Dholakia, East Windsor, N.J.

[73] Assignee: RCA Corporation, New York, N.Y.

[21] Appl. No.: 190,647

[22] Filed: Sep. 25, 1980

[51] Int. Cl.[3] ..... B24B 19/00

[52] U.S. Cl. ..... 51/277; 51/229; 51/220

[58] Field of Search ..... 51/283, 281 SF, 281, 51/277, 241 R, 229, 239, 238 R, 238 S, 216 R, 216 LP, 216 A, 216 H, 241 R, 240 R, 220, 221 R, 221 BS; 369/71, 170, 171, 172, 173

[56] References Cited

U.S. PATENT DOCUMENTS

| | | | |
|---|---|---|---|
| 1,958,021 | 5/1934 | Schmidt | 51/277 |
| 2,449,423 | 9/1948 | Spira . | |
| 2,501,872 | 3/1950 | Mencke | 369/170 |
| 2,641,879 | 6/1953 | Dalrymple | 51/277 |
| 3,135,073 | 6/1964 | Odle | 51/229 |
| 3,461,622 | 8/1969 | Rayford . | |
| 3,466,812 | 9/1969 | Liebowitz . | |
| 3,688,452 | 9/1972 | Stevens | 51/229 |
| 3,763,611 | 10/1973 | Dühring et al. | 51/216 R |
| 3,842,194 | 10/1974 | Clemens . | |
| 4,035,590 | 7/1977 | Halter . | |
| 4,044,379 | 8/1977 | Halter . | |
| 4,082,213 | 4/1978 | Rangabe | 51/216 R |
| 4,265,057 | 5/1981 | Hoffman | 51/229 |

*Primary Examiner*—Stephen G. Kunin
*Assistant Examiner*—Robert A. Rose
*Attorney, Agent, or Firm*—E. M. Whitacre; J. S. Tripoli; J. E. Roehling

[57] ABSTRACT

Apparatus for orienting a cutting stylus having a mounting face and a cutting face includes a base member having a flat, nonadhesive surface and a stylus holding fixture. The stylus holding fixture includes a mounting block having a surface vertical to the flat, nonadhesive surface of the base member. The cutting stylus is attached with epoxy to the vertical surface of the mounting block which forms the proper angle to orient the cutting face of the stylus for subsequent lapping on a lapping machine. A capping plate having a recess for the cutting stylus is attached to the mounting face of the mounting block. With the stylus mounted in the mounting block the stylus holding fixture may now be placed on a lapping machine for the stylus lapping process.

7 Claims, 3 Drawing Figures

APPARATUS AND METHOD FOR SHARPENING A CUTTING STYLUS

BACKGROUND OF THE INVENTION

This invention relates to an apparatus and method for sharpening a stylus and, more particularly, to an apparatus and method for sharpening a diamond cutting stylus which is to be used in a mastering process to produce high density information records, such as video disc records of the type described in U.S. Pat. No. 3,842,194 to J. K. Clemens.

The Clemens' patent discloses a video disc for use with a playback system of the variable capacitance type. In one configuration of the Clemens' system information representative of recorded picture and sound is encoded in the form of a relief pattern in a relatively fine spiral groove on the surface of a disc record. For example, groove widths of approximately 2.6 micrometers and groove depths of about 0.5 micrometers may be used. During playback, capacitive variations between a conductive electrode on a stylus and a conductive property of the disc record are sensed to recover the prerecorded information.

In accordance with the Clemens' format, the video information may be recorded as relatively short (e.g., 0.6–1.6 micrometers) relief variations along the length of the spiral groove. Illustratively, the method of recording may be of a type shown in U.S. Pat. No. 4,044,379 to J. B. Halter. Pursuant to the Halter method, an electromechanically-driven stylus (e.g., of diamond) having a triangular shape, responsive to a combined video and audio signal, records relatively short geometric variations, representative of the time variations of the signal, on a surface of a metal substrate. After the electromechanical recording operation, the recorded surface of the metal substrate has a relief pattern corresponding to that which is desired in the final record. In the replicating process, masters are made from the substrate. Molds are then made from the masters and stampers are made from the molds. The stampers are used in the process of pressing a vinyl record having the desired relief pattern.

In order to record the fine groove and signal structure typically employed in video discs, the recording stylus must cut the groove and signal information without tearing, smearing, chattering, ripping or chipping the surface of the metal substrate during the recording process. The geometric variations along the length of the groove should be a substantially accurate representation of the modulated signals recorded thereon. Bearing in mind the extremely dense nature of the information recorded in the groove structure of the video disc, it will be appreciated that the generation of substrates of acceptable quality is critical in the record mastering process. Any significant incident of machining inperfections in the finished surface results in a substrate which is not acceptable in the manufacturing of records having such a highly dense information content.

It has been discovered that only the hardest materials (e.g., diamond) are acceptable for video recording styli and, further, that the cutting edges of the styli must be extremely sharp to produce substrates to such demanding standards. Sharpening styli used to cut substrates in accordance with these standards presents unique problems to the diamond tool industry.

The stylus structure used to record according to the Halter Method is extremely small. As noted above the signal element and groove structure cut on the master substrate is extremely fine. Further, the video bandwidth (e.g., 0–3 MHz) and modulating frequencies (e.g., up to 6.3 MHz) necessitate the use of an electromechanical cutterhead having a low mass. Generally, a low mass cutterhead has a principle resonant frequency at the upper end of the bandwidth. To provide a stylus suitable for cutting the fine signal structure and having a low mass requires that the stylus structure be miniature in size as compared to styli used in other recording systems, such as audio recording.

Cutting styli for use in electromechanical recording of video information are in short supply and very expensive. The process of manufacturing a new stylus from a rough diamond is tedious. It requires grinding and polishing of several facets. The present invention provides a method and apparatus for use in re-sharpening styli which have become unusable after some period of use in the electromechanical recorder. The size and necessity for such sharp cutting edges affects the methods of handling. During stylus resharpening problems arise with respect to orienting the stylus on the lapping or grinding machine and holding it during the lapping and grinding operation.

SUMMARY OF THE INVENTION

In accordance with the principles of the present invention an apparatus and method for sharpening cutting styli used for video recording is provided.

Further, in accordance with the principles of the present invention, apparatus is provided for orienting a cutting stylus prior to grinding. The cutting stylus has a mounting face used to attach the stylus to the piezoelectric element of the electromechanical cutter and a cutting face used to cut video signal information in a metal master. The orienting apparatus comprises the combination of a base member having a flat, nonadhesive surface and a stylus holding fixture. The stylus holding fixture which has a stylus attaching face is arranged on the flat, nonadhesive surface of the base member such that the attaching face is positioned at a particular angle with respect to the flat, nonadhesive surface. This particular angle is made equal to the angle between the cutting face and the mounting face of the cutting stylus. When the stylus holding fixture having the stylus mounted thereon, is located in a grinding machine for stylus resharpening the cutting face of the stylus is presented at the proper orientation for sharpening.

BRIEF DESCRIPTION OF THE DRAWING

Other features and advantages of the invention will be more fully understood from the following detailed description of the preferred embodiment, the appended claims and the accompanying drawing in which:

DESCRIPTION OF THE PREFERRED EMBODIMENT

Figure 1:
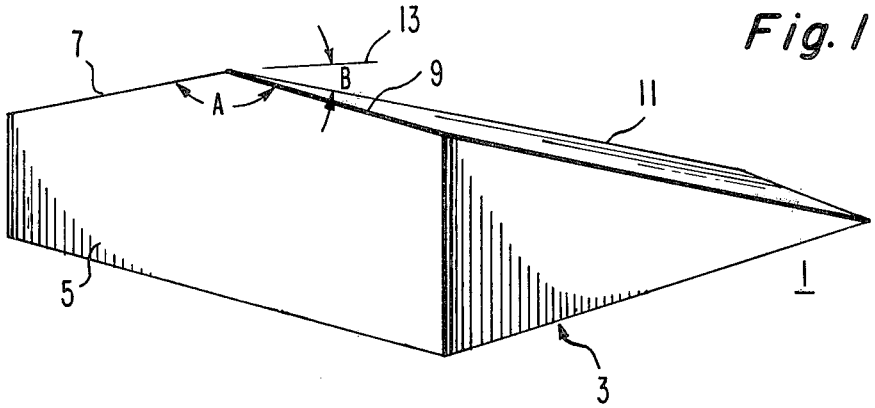
FIG. 1 is a perspective view of a cutting stylus used for cutting a master video disc record.

Referring to FIG. 1 a perspective view of a cutting stylus 1 formed of an extremely hard material (illustratively, diamond) is shown. In an electromechanical cutting operation the cutting stylus is mounted by base 3 in a cutterhead assembly to the piezoelectric element of the cutterhead. A cutterhead for electromechanically recording a video signal in a metal master is described in U.S. Pat. No. 4,035,590, issued to J. B. Halter on July 2, 1977, and entitled, "Apparatus for Electromechanical Recording of Short Wavelength Modulation in a Metal Master". Illustratively, cutting styli used for cutting signal information for a Clemens' type record has physical dimensions of a cube having approximately 150 μm sides.

A cutting face 5 is formed on cutting stylus 1 at an angle of 90 degrees to the plane of base 3. The included angle A of the cutting stylus 1 is the angle subtended between the cutting edges 7 and 9 of the stylus. The shape of cutting edges 7 and 9 as illustrated in FIG. 1 will form a triangular groove into the recording master. It should be appreciated by those of skill in the art that other groove shapes and styli shapes are equally included within the scope of the present invention. The clearance angle B of the cutting stylus 1 is the angle subtended by the trailing edge 11 of the cutting stylus 1 with imaginary line 13 which represents the line of motion of the cutting stylus with respect to a recording master during the cutting operation.

Short wavelength variations of approximately 0.6 micrometers are cut on the inside diameter (illustratively, 17 centimeters) of the recordingmaster while recording a high signal frequency (illustratively, 6.3 MHz) at a recording speed of 450 rpm. A peak-to-peak groove modulation of approximately 0.1 micrometer provides an adequate signal-to-noise ratio for video discs generated from a metal substrate cut with cutting stylus 1. A groove modulation having a peak-to-peak dimension of 0.1 micrometer and a wavelength of 0.6 micrometer will have a maximum slope at its zero crossing of approximately 28 degrees. The trailing edge of the cutting stylus 1, therefore, must have a slope greater than 28 degrees in order to avoid interference with previously recorded groove modulation in the region of maximum slope at the innermost diameter while recording the highest signal frequency. Grinding a flaw-free cutting edge with a clearance angle of greater than 28 degrees on a diamond stylus of the dimensions discussed herein present practical problems of alignment and orientation which are reduced by apparatus of the present invention.

Figure 2:
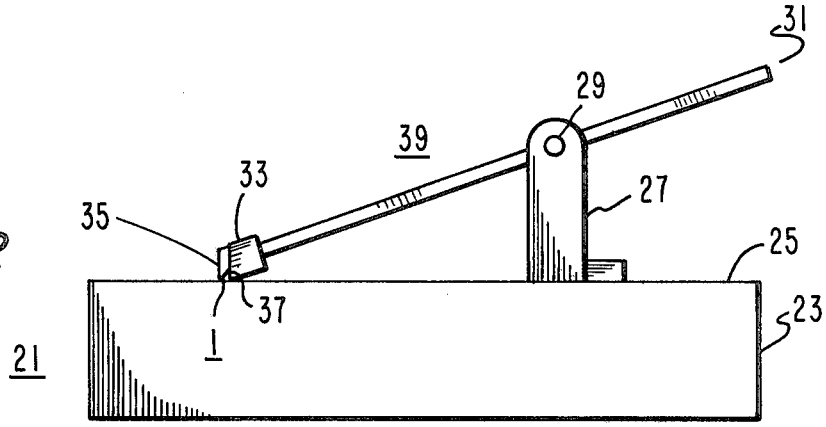
FIG. 2 shows a side elevation view of a fixture used for mounting the cutting stylus prior to a sharpening operation, incorporating the principles of the present invention.
Figure 3:
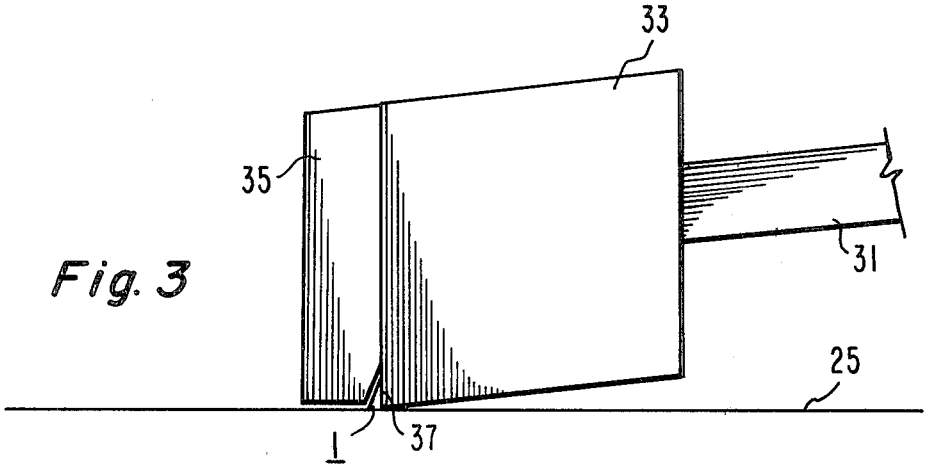
FIG. 3 shows an enlarged elevation side view of a portion of the fixture shown in FIG. 2.

FIGS. 2 and 3 illustrate, respectively, an elevation and an enlarged view of an orienting apparatus used for holding a cutting stylus of the type described with reference to FIG. 1. Orienting apparatus 21 includes a base plate 23 having a flat, nonadhesive surface 25. Illustratively, baseplate 23 may have a nonadhesive surface formed of polytetrafluoroethylene (commonly known as TEFLON (Trademark)). Resting on surface 25 of base member 23 is foundation 27 of stylus holding fixture 39. Coupled to foundation 27 via pivot 29, which may illustratively be a ball bearing pivot, is lapping pencil 31. Attached to one end of lapping pencil 31 is a mounting block 33. Capping plate 35 which is detachable from mounting block 33 forms a recess 37 into which cutting stylus 1 may be inserted.

Stylus holding fixture 39 holds the cutting device 1 at a particular orientation. When holding fixture 39 is mounted onto a lapping or grinding machine for grinding face 5 of stylus 1 to sharpen cutting edges 7 and 9, cutting face 5 is presented parallel to the lapping or grinding surface of the lapping or grinding machine.

Using the apparatus of the present invention permits stylus orientation. Stylus holding fixture 39, with capping plate 35 removed, is placed on surface 25 of base member 23. The mounting surface of mounting block 33 which corresponds to recess 37 of capping plate 35 is arranged to be vertical when mounting block 33 pivotably rests on surface 25. Cutting stylus 1, which is arranged with cutting face 5 against surface 25, is pushed against the mounting surface of mounting block 33 onto which a drop of epoxy resin has been applied. The cutting stylus is checked to make certain that cutting face 5 is resting squarely on surface 25. After the epoxy cures the capping plate 35 is fastened to mounting block 33 with some mechanical means, such as a screw. Recess 37 in capping plate 35 makes a cavity for cutting stylus 1. After capping plate 35 is assembled, recess 37 is filled up with epoxy resin to encase the cutting stylus on all sides, except face 5 which is to be ground. After the epoxy cures stylus holding fixture 39 with stylus 1 attached maybe removed from base 23. Notice that the epoxy will stick to the mounting block 33 but not to surface 25 which is formed of a nonadhesive material.

The cutting stylus 1 which is now mounted to fixture 39 is ready for grinding, polishing or lapping. Fixture 39 can now be positioned on a lapping scaife covered with a lapping material (illustratively a 0.1 micrometer diamond powder) to grind the cutting face 5 to the desired finish to yield acceptable quality cutting styli.

What is claimed is:

1. Apparatus for orienting a cutting stylus, having a mounting face and a cutting face used to cut video signal information in a metal master, said apparatus comprising the combination of:

a base member having a flat surface; and a stylus holding feature having a stylus attaching face, said stylus holding fixture being arranged on said flat surface of said base member such that said attaching face is positioned at an angle with respect to said flat surface which is equal to the angle between said cutting face and said mounting face of said cutting stylus and said cutting face of said stylus is presented at a given orientation when said stylus holding fixture having said stylus mounted thereon is mounted in a grinding machine for stylus resharpening;

said cutting stylus being bonded to said stylus attaching face of said stylus holding fixture with an adhesive;

said flat surface of said base member being formed of a material that does not bond to the adhesive used to bond said cutting stylus to said stylus attaching face.

2. The apparatus according to claim 1 wherein said flat surface is formed of a material which does not bond to an epoxy resin.

3. The apparatus according to claim 2 wherein said flat surface is formed of polytetrafluoroethylene.

4. The apparatus according to claim 3 wherein the angle between said cutting face and said mounting face is 90 degrees.

5. The apparatus according to claim 4 wherein said adhesive is an epoxy resin material.

6. The apparatus according to claim 5 wherein said stylus holding fixture comprises:

a foundation having a surface in contact with said flat, surface of said base member;

a shaft pivotably coupled to said foundation; and a mounting block, coupled to said shaft, said stylus attaching face being formed on a surface of said mounting block.

7. The apparatus according to claim 6 further comprising:

a capping plate having a recess for receiving said cutting stylus attached to said stylus attaching face of said mounting block.

* * * * *